United States Patent [19]

Henson et al.

[11] Patent Number: 4,663,121

[45] Date of Patent: May 5, 1987

[54] USE OF PHENYLOXAZOLES AS CORROSION INHIBITORS

[75] Inventors: Edwin R. Henson, Lake Jackson; Joel G. Courtwright, Angleton, both of Tex.

[73] Assignee: The Dow Chemical Company, Midland, Mich.

[21] Appl. No.: 787,335

[22] Filed: Oct. 15, 1985

[51] Int. Cl.[4] ..... C23F 11/04

[52] U.S. Cl. ..... 422/12; 422/16; 546/275; 548/235; 252/148; 252/392

[58] Field of Search ..... 548/235; 546/275; 422/12, 16; 252/392, 148

[56] References Cited

U.S. PATENT DOCUMENTS

| | | | |
|---|---|---|---|
| 2,924,571 | 2/1960 | Hughes | 252/8.555 |
| 2,964,471 | 12/1960 | Hughes | 252/8.555 |
| 3,014,864 | 12/1961 | Hughes et al. | 252/8.555 |
| 3,257,203 | 6/1966 | Süs et al. | 548/235 X |
| 3,260,669 | 7/1966 | Schoen | 252/8.555 |
| 3,279,918 | 10/1966 | Cassiers et al. | 548/235 X |
| 3,872,096 | 3/1975 | Witte et al. | 252/392 X |
| 4,235,838 | 11/1980 | Redmore et al. | 422/7 |
| 4,266,944 | 5/1981 | Sung | 252/392 X |

*Primary Examiner*—John F. Terapane
*Assistant Examiner*—Matthew A. Thexton

[57] ABSTRACT

The corrosion of metals in contact with corrosive fluids is effectively inhibited by the addition of one or more phenyloxazoles, preferably 2,5-diphenyloxazole.

5 Claims, No Drawings

USE OF PHENYLOXAZOLES AS CORROSION INHIBITORS

FIELD OF THE INVENTION

The invention relates to inhibiting or preventing corrosion of metals in contact with a corrosive fluid. More particularly, the invention relates to the addition of an inhibitor to the corrosive fluid.

BACKGROUND OF THE INVENTION

Corrosive fluids such as organic and mineral acids are used for a wide variety of industrial applications for which the corrosion of metals is a significant problem. A solution to the problem is the addition of corrosion inhibitors to the corrosive fluid in concentrations effective to inhibit corrosion of the metals without significantly reducing the effectiveness of the corrosive fluid. However, corrosion mechanisms are not well understood and a selection of inhibitors is generally done by trial and error.

At the present time, most commercially available corrosion inhibitors useful for addition to corrosive fluids consist of complex mixtures of chemicals. An exception is U.S. Pat. No. 4,235,838 which describes the use of benzazoles, e.g. 2-(3-aminopropyl)benzoxazole, as sole corrosion inhibitors.

SUMMARY OF THE INVENTION

The present invention is a method of inhibiting or preventing corrosion of metals in contact with a corrosive fluid, comprising the step of adding to the corrosive fluid a corrosion inhibiting amount of an oxazole having the following formula:

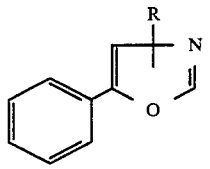

where R is phenyl, biphenyl or pyridyl; derivatives thereof; or combinations thereof. One of the oxazoles, 2,5-diphenyloxazole, provides corrosion inhibition that is comparable to commercially available inhibitors having complex compositions.

DETAILED DESCRIPTION OF THE INVENTION

The present invention is a method of inhibiting or preventing corrosion of metals in contact with a corrosive fluid, comprising the step of adding to the corrosive fluid a corrosion inhibiting amount of an oxazole having the following formula:

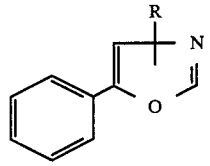

where R is phenyl, biphenyl or pyridyl; derivatives thereof; or combinations thereof.

The oxazoles used as inhibitors in this invention are hereinafter called phenyloxazoles and are well known in the art. One of the oxazoles 2,5-diphenyloxazole, provides corrosion inhibition that is comparable to commercially available inhibitors having complex compositions.

The phenyloxazoles can be added to corrosive fluids in a wide variety of methods as long as the phenyloxazoles are reasonably dispersed throughout the corrosive fluid.

Like most such inhibitors, phenyloxazoles apparently inhibit corrosion by migrating from the corrosive fluid to metal surfaces where corrosion is inhibited by some unknown mechanism. The solubility of the inhibitor is known to be important with respect to the ability of the inhibitor to migrate to metal surfaces and phenyloxazoles in general apparently have the right combination of solubility and other properties required for effective corrosion inhibition.

The effective concentrations of the corrosion inhibitors of this invention will vary widely depending on the particular industrial application. A concentration of the phenyloxazoles of about 0.005 percent by weight of the corrosive fluid approximates the lower limit of effectiveness. Concentrations of from about 0.1 to about 0.5 percent by weight of the corrosive fluid are preferred. Larger amounts of the phenyloxazoles are effective although any increase in corrosion inhibition is small in comparison to the increased use of the phenyloxazoles.

The following examples demonstrate the use and effectiveness of the inhibitors of the present invention and are not intended to limit the invention to specific compounds or concentrations.

Example I

The following table provides the results of corrosion testing using selected phenyloxazoles. Each phenyloxazole was added to a 10 percent aqueous solution of HCL to give a concentration of the inhibitor of 0.2 percent by weight of the inhibited acid. A mild steel was then exposed to each inhibited acid solution at 175° F. for six hours. Corrosion rates were determined by weight loss and are reported as a decrease in mils of thickness per year (mpy).

| Inhibitor | Average Corrosion Rate, mpy |
|---|---|
| 2,5-diphenyloxazole | 327 |
| 2-(4-pyridyl)-5-phenyloxazole | 1,145 |
| 2-methyl-4,5-diphenyloxazole | 3,635 |
| 2-(4-biphenylyl)-5-phenyloxazole | 3,836 |

Example II (Comparison)

The following Table presents comparative corrosion rates for the uninhibited acid of Example I and for commercial inhibitors under the conditions of Example I.

| Inhibitor | Average Corrosion Rate, mpy |
|---|---|
| Uninhibited | 14,601 |
| Amchem Rodine 1150* | 872 |
| Harry Miller 1803** | 775 |

*Trademark of Amchem Products, Inc. for a mixture of compounds unknown to Applicants.

**Trademark of Harry Miller Corp. for a mixture of compounds unknown to Applicants.

Comparing the results of Examples I and II, a variety of phenyloxazoles are shown to be effective corrosion inhibitors. Each of the phenyloxazoles has the general formula indicated above with the exception of 2-methyl-4,5-diphenyloxazole which is a methyl derivative of 4,5-diphenyloxazole. The results further establish that 2,5-diphenyloxazole is more effective than the tested commercial inhibitors.

Example III

The following Table presents corrosion rates for varying concentrations of 2,5-diphenyloxazole under the conditions of Example I:

| 2,5-Diphenyloxazole Concentration, Weight % | Average Corrosion Rate, mpy |
|---|---|
| 0.0 | 13,388 |
| 0.005 | 10,812 |
| 0.05 | 847 |
| 0.10 | 642 |
| 0.20 | 327 |
| 0.50 | 406 |
| 1.00 | 230 |

Example IV

The following Table presents corrosion rates for a variety of acids inhibited with 2,5-diphenyloxazole under the conditions of Example I.

| Inhibited Acid, 0.2% By Weight 2,5-Diphenyloxazole | Average Corrosion Rate, mpy |
|---|---|
| 10% HCL | 327 |
| 10% $H_2SO_4$ | 2,696 |
| 10% Acetic Acid | 475 |

Example V (Comparison)

The following Table presents the corrosion rates for the uninhibited acids of Example IV:

| Uninhibited Acids | Average Corrosion Rate, mpy |
|---|---|
| 10% HCL | 15,008 |
| 10% $H_2SO_4$ | 10,245 |
| 10% Acetic Acid | 1,054 |

What is claimed is:

1. A method of inhibiting or preventing corrosion of metals in contact with a corrosive fluid, comprising the step of adding to the corrosive fluid a corrosive inhibiting amount of an oxazole having the following formula:

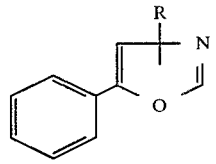

where R is phenyl, biphenyl or pyridyl; derivatives thereof; or combinations thereof.

2. The method of claim 1, wherein the addition of the oxazole results in a concentration of the oxazole of at least 0.005% by weight of the inhibited corrosive fluid.

3. The method of claim 1, wherein the addition of the oxazole results in a concentration of the oxazole of from about 0.1 to about 0.5% by weight of the inhibited corrosive fluid.

4. The method of claim 1, wherein the oxazole is 2,5-diphenyloxazole, derivatives thereof, or combinations thereof.

5. The method of claim 1, wherein the inhibitor is 2-(4-pyridyl)-5-phenyloxazole, derivatives thereof, or combinations thereof.

* * * * *